US010214226B2

(12) United States Patent
Simon

(10) Patent No.: US 10,214,226 B2
(45) Date of Patent: Feb. 26, 2019

(54) METHOD FOR OPERATING A TRAIN SAFETY ASSEMBLY, TRAIN SAFETY ASSEMBLY AND RAIL VEHICLE COMPRISING A TRAIN SAFETY ASSEMBLY

(71) Applicant: SIEMENS AKTIENGESELLSCHAFT, Munich (DE)

(72) Inventor: Frank Simon, Cremlingen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/566,779

(22) PCT Filed: Mar. 30, 2016

(86) PCT No.: PCT/EP2016/056838
§ 371 (c)(1),
(2) Date: Oct. 16, 2017

(87) PCT Pub. No.: WO2016/165935
PCT Pub. Date: Oct. 20, 2016

(65) Prior Publication Data

US 2018/0118241 A1 May 3, 2018

(30) Foreign Application Priority Data

Apr. 14, 2015 (DE) ..... 10 2015 206 666

(51) Int. Cl.
*B61L 15/00* (2006.01)
*B61L 27/00* (2006.01)

(52) U.S. Cl.
CPC ..... *B61L 27/0005* (2013.01); *B61L 15/0063* (2013.01); *B61L 15/0081* (2013.01); *B61L 27/0038* (2013.01); *B61L 2027/0044* (2013.01)

(58) Field of Classification Search
CPC ..... B61L 15/0063; B61L 15/0072; B61L 15/0081; B61L 27/0005; B61L 27/0038;
(Continued)

(56) References Cited

U.S. PATENT DOCUMENTS 6,467,088 B1 * 10/2002 alSafadi ..... G06F 8/65 713/100
7,188,341 B1 * 3/2007 Hawthorne ..... B61L 3/125 717/171

(Continued)

FOREIGN PATENT DOCUMENTS

EP 1659046 A1 5/2006
EP 2279926 A1 2/2011

OTHER PUBLICATIONS

ERTMS/ETCS—Class 1; "Specific Transmission Module FFFIS"; Subset-035, Issue: 2.1.1, Jul. 24, 2003; (This document is the property of Alcatel Alstom Ansaldo Signal Bombardier Invensys Rail Siemens) pp. 1-177;-Engl. Summery.

(Continued)

*Primary Examiner* — Andrew M. Lyons
(74) *Attorney, Agent, or Firm* — Laurence Greenberg; Werner Stemer; Ralph Locher

(57) ABSTRACT

A train safety assembly has an onboard apparatus of a first train safety system and a specific transmission device for transmission with a trackside part of a second train safety system. The onboard apparatus is started using a version of a first software and the specific transmission device is started using a version of a second software. The versions of the first and second software are checked for their compatibility. In order to be able to provide the train safety assembly for use on a track section, which is equipped with the trackside part of the second train safety system, and to put same into operation in a faster and more cost-efficient manner, if the started versions of the first and second software are incom- (Continued)

patible, the transmission device is automatically restarted with another version of the second software, and the started first and second software are checked for their compatibility.

18 Claims, 2 Drawing Sheets

(58) Field of Classification Search
CPC ..... B61L 27/0055; B61L 27/0083; B61L 27/0088; B61L 27/0094; B61L 2007/0044; G06F 8/70; G06F 8/71
USPC ..... 116/30; 246/3–18, 166.1, 208; 717/120, 717/121, 168, 170, 171
See application file for complete search history.

(56) References Cited

U.S. PATENT DOCUMENTS 7,386,845 B1 * 6/2008 Fox ..... G06F 8/61 717/169
8,151,257 B2 * 4/2012 Zachmann ..... G06F 8/656 717/170
8,255,896 B2 * 8/2012 Wontorcik ..... G06Q 10/06 340/506
9,003,363 B2 * 4/2015 Lupu ..... G06F 9/4413 340/870.02
9,411,576 B2 * 8/2016 Hocker ..... G06F 8/71
9,645,812 B2 * 5/2017 Proschowsky ..... G06F 8/65
2004/0164206 A1 8/2004 Jammu et al.
2007/0006222 A1 * 1/2007 Maier ..... G06F 8/61 717/174
2008/0022272 A1 * 1/2008 Komano ..... G06F 8/65 717/170
2008/0028386 A1 * 1/2008 Nagamine ..... G06F 8/61 717/170
2008/0243927 A1 * 10/2008 Langen ..... G06Q 10/00
2009/0013317 A1 * 1/2009 Abfalter ..... G06F 8/61 717/170
2010/0146497 A1 * 6/2010 Kogan ..... G06F 8/65 717/170
2010/0169876 A1 * 7/2010 Mann ..... G06F 8/65 717/170
2010/0306757 A1 * 12/2010 Becker ..... G06F 8/71 717/170
2010/0313105 A1 * 12/2010 Nekoomaram ..... G06F 8/654 714/807
2012/0096451 A1 * 4/2012 Tenbarge ..... G06F 11/1433 717/170
2012/0124568 A1 * 5/2012 Fallon ..... G06F 9/453 717/169
2012/0304165 A1 * 11/2012 Bechtel ..... G06F 8/61 717/174
2012/0317562 A1 * 12/2012 Wang ..... G06F 8/65 717/170
2014/0007071 A1 * 1/2014 Chang ..... G06F 8/665 717/170
2014/0059530 A1 * 2/2014 Banavalikar ..... G06F 9/4406 717/170
2014/0157251 A1 * 6/2014 Hocker ..... G06F 8/71 717/170
2014/0282395 A1 * 9/2014 Wang ..... G06F 8/71 717/120
2014/0282469 A1 * 9/2014 Johnson ..... G06F 8/65 717/170
2015/0033295 A1 * 1/2015 Huster ..... G06F 21/44 726/4
2015/0178057 A1 * 6/2015 Miadowicz ..... G06F 8/443 717/151
2015/0339116 A1 * 11/2015 Nekoomaram ..... G06F 8/654 717/169
2015/0347124 A1 * 12/2015 Sotani ..... G06F 8/654 717/170
2016/0092189 A1 * 3/2016 Pollack ..... G06F 8/65 717/175

OTHER PUBLICATIONS

European Railway Agency: "ETCS System Version Management"; pp. 1-42; XP055174088; http://www.era.europa.eu/Document-Register/Documents/Set-2-Index060-SUBSET-104v310.pdf; 2012.
Unisig: "ERTMS/ETCS—Specific Transmission Module FFFIS (Ref:Subset-035, Issue: 3.1.0)"; pp. 1-96; XP055283132; Valenciennes, France; http://www.era.europa.eu/Document-Register/Documents/SUBSET-035 v310.pdf; 2014.
Draeger U: "ETCS und der Uebergang zu den Nationalen Zugsicherungssystemen der DB AG"; Signal+ Draht, DVV; Bd. 96; Nr. 11; pp. 6-15; XP001205535; ISSN: 0037-4997;; 2004.
Heilig C, et al: "Modulare STMs als Tell der Migrationsstrategie von ETCS", Signal+ Draht, Telzlaff Verlag GMBH, Bd. 102, Nr. 3, XP001551495, ISSN: 0037-4997; pp. 28-30; 2010;—Engl. Summery.

* cited by examiner

METHOD FOR OPERATING A TRAIN SAFETY ASSEMBLY, TRAIN SAFETY ASSEMBLY AND RAIL VEHICLE COMPRISING A TRAIN SAFETY ASSEMBLY

BACKGROUND OF THE INVENTION

Field of the Invention

The invention relates to a method for operating a train safety assembly comprising an onboard apparatus of a first train safety system and comprising a specific transmission device, which is connected to the onboard apparatus via an interface and is adapted to a trackside part of a second train safety system, wherein the onboard apparatus is started using a version of a first software, wherein the specific transmission device is started using a version of a second software and wherein the started one version of the first software and the started one version of the second software are checked for their compatibility.

Known generic methods for the version check "Check of version" are described for example in Version 2.1.1 (http://www.era.europa.eu/Document-Register/Documents/Set-1-Index008-SUBSET-035%20v211.pdf) and in Version 3.1.0 (http://www.era.europa.eu/Document-Register/Documents/SUBSET-035%20v310.pdf) of the UNISIG Specification SUBSET-035: "Specific Transmission Module FFFIS".

"UNISIG" ("Union Industry of Signaling") is a workgroup of the Association of the European Rail Industry, which was founded in 1998 with the objective of creating the specifications for a uniform "ERTMS" ("European Rail Traffic Management System"). Here, the uniform European Rail Traffic Management System "ERTMS" has two components—a "European Train Control System" ("ETCS") and a "Global System for Mobile Communication—Railways" ("GSM-R").

Here, the documentation in the UNISIG specifications for the uniform European Rail Traffic Management System, "ERTMS", consists of numerous documents (parts), known as "SUBSETs", some of which are mandatory and some of which are for information only. The documents (parts) have been developed into numerous versions. Sets of specifications have been compiled for specific developments. These sets of documents are inter alia named according to the first number of a "System Requirements Specification—Version", ("SRS V")—i.e. according to the first number of the version of their document relating to the System Requirements Specification SUBSET-026: "System Requirements Specification" ("SRS").

For example, to date, the European Railway Agency, "ERA", has assembled the following two sets of documents on the internet:

- one set of documents designated "ETCS baseline 2 and GSM-R baseline 0", with which the number "2" of the "ETCS baseline" corresponds to the first number "2" of Version 2.3.0 of the UNISIG specification SUBSET-026 (http://www.era.europa.eu/Core-Activities/ERTMS/Pages/Set-of-specifications-1.aspx) and
- one set of documents designated "ETCS baseline 3 and GSM-R baseline 0" with which the number "3" of the "ETCS baseline" corresponds to the first number "3" of Version 3.4.0 of the UNISIG specification SUBSET-026 (http://www.era.europa.eu/Core-Activities/ERTMS/Pages/Set-of-specifications-2.aspx).

In the generic method known as the version check "Check of version", the European Train Safety System, "ETCS", forms the first train safety system. A conventional national train safety system forms the second train safety system.

Per se, equipment according to the European Train Safety System "ETCS"—hereinafter "ETCS equipment" for short—consists of a trackside part and an onboard part so that a rail vehicle with the onboard part of the ETCS equipment is able to travel on sections of track equipped with the trackside part of the ETCS equipment.

However, rail vehicles with the onboard part of the ETCS equipment can also be used on track sections that are equipped, not with the trackside part of the ETCS equipment, but with a trackside part of the equipment of a conventional national train safety system. This is achieved by the use of an additional device in the form of a specific transmission device.

Such a specific transmission device is known as an "STM" ("Specific Transmission Module") or alternatively as "NTC" ("National Train Control"). The "STM" is on the one hand connected via an interface "FFFIS" ("Form Fit Functional Interface Specification") specified in UNISIG documents to an onboard apparatus in the form of an "EVC" ("European Vital Computer") of the onboard part of the ETCS equipment. On the other hand, the "STM" is adapted to the trackside part of the equipment of the conventional national train safety system with which the track section to be traversed is equipped. Here, the specific transmission device takes on the function of receiving, and sometimes also processing, information from the trackside part of the conventional national train safety system.

There are different software versions for the onboard part of the ETCS equipment and for the trackside part of the ETCS equipment. Here, the different software versions correspond to different System Requirements Specification versions, "SRS V", for the European Train Safety System, "ETCS". For example, there are software versions corresponding to "SRS V" 2.3.0—i.e. "ETCS baseline 2"—, wherein hereinafter "ETCS baseline 2" is also referred to as "standard baseline 2" or only "baseline 2".

There are also software versions corresponding to "SRS V" 3.4.0—i.e. "ETCS baseline 3"—wherein hereinafter "ETCS baseline 3" is also referred to as "standard-baseline 3" or only "baseline 3". In the near future, there will be software versions corresponding to a "baseline 4".

At present, both onboard apparatuses ("EVCs") for rail vehicles with which a version of a first software corresponding to "baseline 2" is implemented and onboard apparatuses ("EVCs") with which a version of the first software corresponding to "baseline 3" is implemented are used in practice.

Correspondingly, also used in practice at present are both specific transmission devices ("STMs") with which a version of a second software corresponding to "baseline 2" is implemented and specific transmission devices ("STMs") with which a version of a second software corresponding to "baseline 3" is implemented, wherein the different versions of second software substantially differ with respect to their connection to the interface.

Here, it is possible for constellations to occur in which the implemented versions of the first software of the onboard apparatus and the second software of the specific transmission device are incompatible. In the event of such incompatibility, with the generic method known as the "Version check" "Check of version", the connection between the onboard apparatus and the specific transmission device is interrupted. In practice, this then requires the replacement of the specific transmission device, wherein the incompatible specific transmission device is replaced by a compatible specific transmission device. A device replacement of this kind is expensive and time-consuming.

SUMMARY OF THE INVENTION

Proceeding from the generic method described in the introduction, the invention is based on the object of providing the train safety assembly for use on a track section, which is equipped with the trackside part of the second train safety system, and to put the same into operation in a faster and more cost-efficient manner.

This object is achieved with the method as claimed in that, in the case of incompatibility of the started one version of the first software and the started one version of the second software, the specific transmission device is automatically restarted with another version of the second software and that the started one version of the first software and the started other version of the second software are checked for their compatibility.

This, for example, advantageously enables the specific transmission device to establish a connection both with a variant of the onboard apparatus with which the version of the first software according to "baseline 2" is implemented and with another variant (embodiment) of the onboard apparatus with which the version of the first software according to "baseline 3" is implemented in that it provides different connections to the interface with the different versions of the second software. To this end, it is only necessary to provide the one version of the second software as compatible with the first software according to the "baseline 2" and the other version of the second software as compatible with the first software according to the "baseline 3". Thus, the specific transmission device should be provided as embodied with suitable functions for both variants of the onboard apparatus. In this way, it is also suitably embodied to cope with an update of the first software of the onboard apparatus from the version according to "baseline 2" to the version according to "baseline 3" or vice versa without it having to be replaced.

In one preferred embodiment of the method according to the invention, it is provided that, in the case of incompatibility of the started one version of the first software and the started other version of the second software, the specific transmission device is automatically restarted with a further version of the second software and that the started one version of the first software and the started further version of the second software are checked for their compatibility. This advantageously enables the specific transmission device to establish a connection with a further variant of the onboard apparatus with which the version of the first software is, for example, implemented according to "baseline 4", that will be mandatory in the near future, or also to be available with its functions for this variant of the onboard apparatus. In this way, the specific transmission device could especially also cope with an update to the version according to the future mandatory "baseline 4" without having to be replaced.

It is also considered to be advantageous if, on each restart of the specific transmission device, the onboard apparatus is automatically restarted with the one version of the first software.

It is also considered to be advantageous if a data memory, in particular a non-volatile data memory, with stored version-information on the version of the second software to be started is assigned to the specific transmission device, wherein, on each start and on each restart, to determine the version of the second software to be started, the specific transmission device communicates a version-request signal to the data memory via a data-transmission connection, wherein, in response to the version-request signal, the data memory communicates a version-response signal comprising the stored version-information on the version of the second software to be started to the specific transmission device via the data-transmission connection and wherein, in response to the version-response signal, the specific transmission device starts the version of the second software to be started.

To this end, preferably, before the specific transmission device starts, information on the one version of the second software is stored as version-information in the data memory so that, in response to the version-response signal, the specific transmission device starts with the one version of the second software.

In the case of compatibility of the started one version of the first software and the started one version of the second software, the specific transmission device can advantageously communicate a version-retain signal to the data memory, wherein, in response to the version-retain signal, the information on the one version of the second software is stored or is stored anew in the data memory.

In the case of incompatibility of the started one version of the first software and the started one version of the second software, on the other hand, the specific transmission device advantageously communicates a version-change signal to the data memory, wherein, in response to the version-change signal, instead of the information on the one version of the second software, information on the other version of the second software is stored as version-information in the data memory so that, in response to the version-response signal, the specific transmission device restarts with the other version of the second software.

Accordingly, in the case of compatibility of the started one version of the first software and the started other version of the second software, the specific transmission device can communicate the version-retain signal to the data memory, wherein, in response to the version-retain signal, the information on the other version of the second software remains stored or is stored anew in the date memory.

On the other hand, in the case of incompatibility of the started one version of the first software and the started other version of the second software, the specific transmission device can communicate the version-change signal to the data memory, wherein, in response to the version-change signal, instead of the information on the other version of the second software, information on the further version of the second software is stored as version-information in the data memory so that, in response to the version-response signal, the specific transmission device restarts with the further version of the second software.

One preferred embodiment of the method according to the invention provides the following method steps:

- that the specific transmission device communicates a version-indication signal comprising the version-information on the started version of the second software to the onboard apparatus via the interface,
- that the onboard apparatus uses the communicated version-information on the started version of the second software and version-information on the started version of the first software to check whether the started versions are compatible or incompatible,
- that the onboard apparatus blocks the interface for further communication with the specific transmission device if it identifies the started versions as incompatible,
- that the onboard apparatus communicates a version-indication signal comprising the version-information on the started version of the first software to the specific transmission device via the interface if it identifies the started versions as compatible, that the specific transmission device uses the communicated version-information on the started version of the first software and the version-information on the started version of the second software to check whether the started versions are compatible or incompatible, that the specific transmission device blocks the interface for further communication with the onboard apparatus if it identifies the started versions as incompatible, that the specific transmission device communicates the version-change signal to the data memory if it identifies the started versions as incompatible and that the specific transmission device communicates the version-retain signal to the data memory if it identifies the started versions as compatible.

The following method steps are also advantageous:

that the onboard apparatus keeps the interface free for further communication with the specific transmission device if it identifies the started versions as compatible and that the specific transmission device keeps the interface free for further communication with the onboard apparatus if it identifies the started versions as compatible.

Preferably, the one version of the first software of the onboard apparatus and the versions of the software of the specific transmission device are each provided in accordance with a System Requirements Specification Version of the European Train Safety System, wherein the System Requirements Specification Versions of the European Train Safety System are different to those corresponding to the different software versions of the specific transmission device.

The version-information on the respective version of the software is preferably provided as a number—for example in the form of a major number "X" of a so-called "FFFIS STM version number", as defined in Version 3.1.0 of the UNISIG Specification SUBSET-035 when the first train safety system is a European train safety system ("ETCS").

The invention also relates to a train safety assembly for a rail vehicle comprising an onboard apparatus of a first train safety system and a specific transmission device, which is connected via an interface to the onboard apparatus and adapted to a trackside part of a second train safety system.

In order to be able to provide such a train safety assembly for use on a track section, which is equipped with the trackside part of the second train safety system and put the same into operation in a faster and more cost-efficient manner, it is provided that said train safety assembly is embodied to carry out the method according to the invention.

The invention also relates to a rail vehicle with such a train safety assembly.

BRIEF DESCRIPTION OF THE SEVERAL VIEWS OF THE DRAWING

The invention is described in more detail below with reference to the figures, which show.

DESCRIPTION OF THE INVENTION

Figure 1:
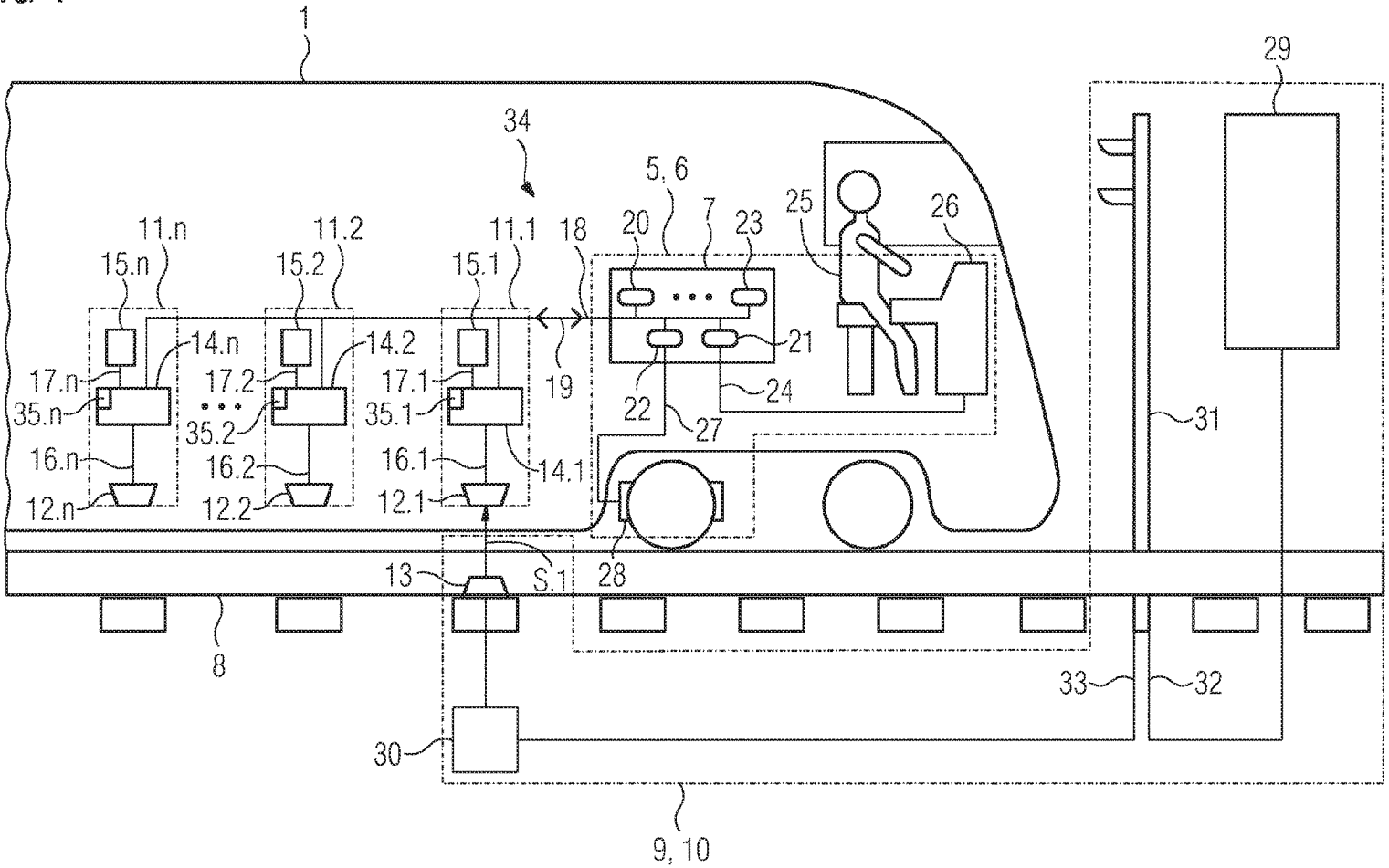
FIG. 1 a rail vehicle with a train safety assembly according to the invention and FIG. 2 a schematic representation of the method according to the invention.

The rail vehicle 1 shown comprises onboard equipment of a first train safety system 6 designated with 5 as a whole. The first train safety system 6 is a European Train Safety System ("ETCS"). The onboard equipment 5 comprises an onboard apparatus 7 in the form of an ETCS onboard computer ("EVC").

The rail vehicle 1 is located on a track section 8 equipped with trackside equipment 9 of a second train safety system 10. The second train safety system 10 is a train safety system according to a national standard; here for example the Danish train safety system "ZUB 123".

The rail vehicle 1 comprises at least one onboard facility 11.1, which is adapted to the second train safety system 10 in order to be able to travel on the track section 5 shown.

The rail vehicle 1 can also comprise further onboard facilities 11.2, . . . , 11.n, which are adapted to further train safety systems in order also to be able to travel on sections of track equipped with trackside equipment of these further train safety systems. The further train safety systems are train safety systems according to further national standards, for example the German train safety system "INDUSI" or the French train safety system "TVM".

The onboard facilities 11.1, 11.2, . . . , 11.n comprise receivers 12.1, 12.2, . . . , 12.n, which are suitably embodied to receive signals from transmitters of assigned trackside equipment. For example, the onboard facility 10.1 comprises the receiver 12.1, which is suitably embodied to receive signals, here designated S.1 as a whole, from a transmitter 13 of the trackside equipment 9 shown of the second train safety system 10. The signals S.1 are used to transmit information on the second train safety system 10.

The onboard facilities 11.1, 11.3, . . . , 11.n further comprise specific transmission devices 14.1, 14.2, . . . , 14.n and non-volatile data memories 15.1, 15.2, . . . , 15.n, wherein the specific transmission devices 14.1, 14.2, . . . , 14.n are communicatively connected to the receivers 12.1, 12.2, . . . , 12.n via first data transmission links 16.1, 16.2, . . . , 16.n and to the non-volatile data memories 15.1, 15.2, . . . , 15.n via second data transmission links 17.1, 17.2, . . . , 17.n. For example, the onboard facility 11.1 comprises the specific transmission device 14.1 and the non-volatile data memory 15.1, wherein the specific transmission device 14.1 is communicatively connected to the receiver 11.1, embodied as a vehicle coupling coil, via the first data-transmission connection 16.1 and to the non-volatile data memory 15.1 via the second data-transmission connection 17.1.

The specific transmission devices 14.1, 14.2, . . . , 14.n are adapted to the trackside part of the respective second train safety system. For example, the specific transmission device 14.1 is adapted to the trackside part 9 of the second train safety system 10 such that it is able to receive, and to some extent also process, the information on the second train safety system 10.

The specific transmission devices 14.1, 14.2, . . . , 14.n are also communicatively connected via a data bus 18, which forms an interface 19, to the onboard apparatus 7 of the first train safety system 6. The interface 19 represents an interface specified in UNISIG documents ("FFFIS").

The onboard apparatus 7 of the first train safety system 6 comprises different functional units connected to the data bus 18. These include inter alia an STM control function unit 20, a driver/machine interface, ("DMI") 21, a brake interface unit, ("BIU") 22 and an odometry unit ("Odometry") 23. Here, the driver/machine interface 21 is connected to a driver's cab display 26 operated by the driver 25 via a data-transmission connection 24 and the brake interface unit 22 is connected to a brake system 28 via a data-transmission connection 27.

In the case of the second train safety system 10 (here by way of example "ZUB 123"), the trackside equipment 9 shown comprises in a known way inter alia a track control center 29, track devices 30 in the form of adapters, track coupling coils functioning as transmitters 13, signals 31 and connection lines 32, 33.

The onboard apparatus 7, the specific transmission device 14.1 of the non-volatile data memory 15.1, the second data-transmission connection 17.1 and the data bus 18 are part of a train safety assembly, designated 34 as a whole, which is suitably embodied to carry out the method described below with reference to FIG. 2.

First, the onboard apparatus 7 is provided with a version $v_i$ of a first software. In addition, the specific transmission device 14.1 is provided with least two versions $V_I$, $V_{II}$ of a second software. Also held resident in the specific transmission device or in the data memory is a list with information on the different versions of the second software. In the present exemplary embodiment, the list 35.1 is held resident in the specific transmission device 14.1. In the first place, the list 35.1 contains information on the one version $V_I$ and, in the second place, information on the other version $V_{II}$ of the second software.

Here, the version $v_i$ of the first software of the onboard apparatus 7 and the versions $V_I$ and $V_{II}$ of the software of the specific transmission device 14.1 are each provided according to a System Requirements Specification Version SRS V of the European Train Safety System, wherein the System Requirements Specification Versions of the European Train Safety System to which the software versions $V_I$ and $V_{II}$ of the specific transmission device 14.1 correspond are different.

In addition, information on one of the versions $V_I$, $V_{II}$ of the second software—i.e. information from the list 35.1—is stored as version-information $V_{Info}$ in the non-volatile data memory 15.1. Therefore, the non-volatile data memory is provided with the stored version-information $V_{Info}$ on the one version of the second software to be started (see method step 40 in FIG. 2).

The version-information $V_{Info}$ is a number. This number can, for example, be provided in the form of a "FFFIS STM version number" provided as defined in Version 3.1.0 of the UNISIG Specification SUBSET-035. In the present exemplary embodiment, the version-information $V_{Info}$ is provided as a major number "X" of the "FFFIS STM version number". X=3—i.e. the major number "3"—is a version of the second software corresponding to "baseline 2". X=4 —i.e. the major number "4" is a version of the second software corresponding to "baseline 3". In the present exemplary embodiment, therefore, the list 35.1 contains two major numbers—namely in first position the major number "3" and in second position the major number "4".

First, the onboard apparatus 7 and the specific transmission device 14.1 are started—i.e. run up. The start of the two devices is designated 41 in FIG. 2. The onboard apparatus 7 starts with its one version $v_i$ of the first software.

Figure 2:
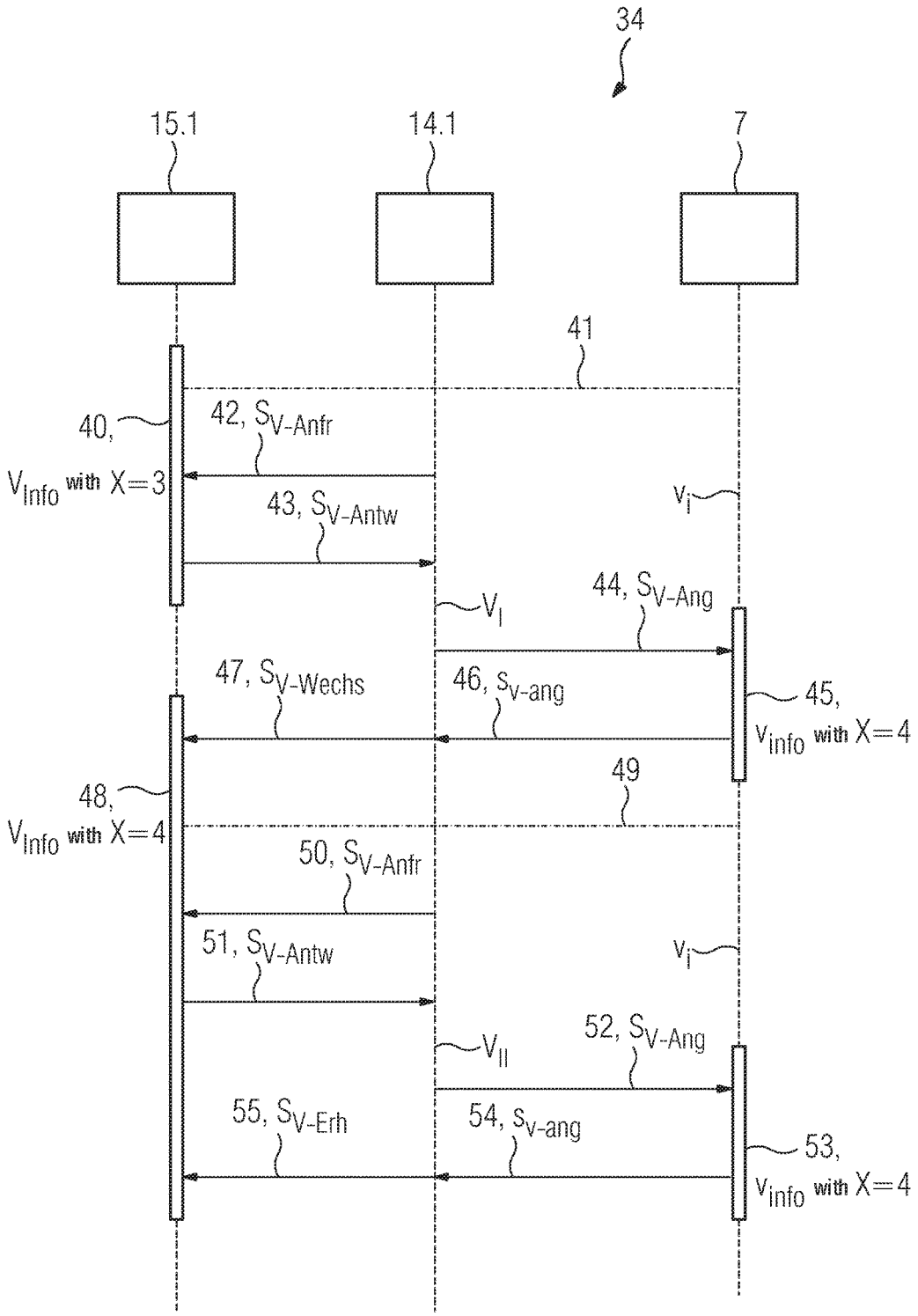

To determine the version of the second software to be started, the specific transmission device 14.1 communicates a version-request signal $S_{v\text{-}Anfr}$ to the data memory 15.1 via the data-transmission connection 17.1 (see method step 42 in FIG. 2). In response to the version-request signal $S_{V\text{-}Anfr}$ , the data memory 15.1 communicates a version-response signal $S_{V\text{-}Antw}$ to the specific transmission device 14.1 via the data-transmission connection 17.1 (see method step 43 in FIG. 2). The version-response signal $S_{V\text{-}Antw}$ comprises the stored version-information $V_{Info}$ on the version of the second software to be started, i.e. here first the major number "3". In response to the version-response signal $S_{V\text{-}Antw}$, the specific transmission device 14.1 starts with its version $V_I$ of the second software, which in the exemplary embodiment shown, corresponds to "baseline 2".

If, at first, no version-information $V_{Info}$ were stored in the data memory 15.1, the specific transmission device 14.1 would use the information in first place in the list 35.1—i.e. here, the major number "3", as version-information and accordingly start with the version $V_I$.

The specific transmission device 14.1 communicates the version-indication signal $S_{V\text{-}Ang}$ comprising the version-information $V_{Info}$ on the started one version $V_I$ of the second software to the onboard apparatus 7 via the interface 19 (see method step 44 in FIG. 2).

The onboard apparatus 7 uses the communicated version-information $V_{Info}$ on the started one version $V_I$ of the second software and version-information $v_{info}$ on the started version $v_i$ of the started first software to check whether the started versions $V_I$, $v_i$ are compatible or incompatible (see method step 45 in FIG. 2).

The onboard apparatus 7 would communicate a version-indication signal Sv_ang comprising the version-information $v_{info}$ on the started version $v_i$ of the first software to the specific transmission device 14.1 via the interface 19 if it identifies the started versions $V_I$, $v_i$ as compatible.

Then, the specific transmission device 14 would use the communicated version-information $v_{info}$ on the started version $v_i$ of the first software and the version-information $V_{Info}$ on the started version $V_I$ of the second software to check whether the started versions are compatible or incompatible.

The specific transmission device 14.1 would then communicate a version-retain signal $S_{V\text{-}Erh}$ to the data memory 15.1 if it identifies the started versions $V_I$, $v_i$ as compatible.

In response to the version-retain signal $S_{v\text{-}Erh}$, the information on the one version $V_I$ of the second software—i.e. here the major number "3" would remain stored in the data memory 15.1 or be stored there anew.

However, in the exemplary embodiment depicted in FIG. 2, the STM control function unit 20 of the onboard apparatus 7 recognizes that the two versions $V_I$, $v_i$ are incompatible.

Although the onboard apparatus 7 still communicates its version-indication signal $S_{v\ ang}$ comprising the version-information $v_{info}$ on the started version $v_i$ of the first software to the specific transmission device 14.1 (see method step 46 in FIG. 2), it then on its part blocks the interface 19 for further communication with the specific transmission device 14.1 since it has identified the started versions $V_I$, $v_i$ as incompatible.

And, the specific transmission device 14.1 on its part also blocks the interface 19 for further communication with the onboard apparatus 7 since it has identified the started versions $V_I$, $v_i$ as incompatible.

The specific transmission device 14.1 also communicates a version-change signal $S_{V\text{-}Wechs}$ to the data memory 15.1 because it has identified the started versions as incompatible (see method step 47 in FIG. 2).

In response to the version-change signal $S_{V\text{-}Wechs}$, instead of the information on the one version $V_I$ of the second software, which here corresponds to baseline 2, the information on the other version $V_{II}$ of the second software, which here corresponds to baseline 3, is stored as version-information $V_{Info}$ in the data memory 15.1. Therefore, now instead of the major number "3", the major number "4" is stored as version-information $V_{Info}$ (see method step 48 in FIG. 2).

Due to the incompatibility of the started one version $v_i$ of the first software and the started one version $V_I$ of the second software, the specific transmission device 14.1 also restarts—and to be precise automatically.

On each restart of the specific transmission device 14.1, the onboard apparatus 7 also restarts with the one version $v_i$ of the first software—and to be precise also automatically. Therefore, the onboard apparatus 7 starts again with its one version $v_i$ of the first software.

The automatic restart of both devices 7 and 14.1 is designated 49 in FIG. 2.

The specific transmission device 14.1 now again communicates its version-request signal $S_{V\text{-}Anfr}$ to the data memory 15.1 (see method step 50 in FIG. 2) and in response thereto again receives the version-response signal $S_{V\text{-}Antw}$ (see method step 51 in FIG. 2). Since the version-response signal $S_{V\text{-}Antw}$ now comprises the major number "4" as version-information $V_{Info}$, the specific transmission device 14.1 now starts with the other version $V_{II}$ of the second software, which corresponds to "baseline 3".

The specific transmission device 14.1 then communicates its version-indication signal $S_{V\text{-}Ang}$, which now comprises the version-information $V_{Info}$ on the started other version $V_{II}$ of the second software, to the onboard apparatus 7 via the interface 19 (see method step 52 in FIG. 2).

Now, first, the onboard apparatus 7 checks the started one version $v_i$ of the first software and the started other version $V_{II}$ of the second software for compatibility (see method step 53 in FIG. 2).

The onboard apparatus 7 again communicates via the interface 19 its version-indication signal $S_{v_ang}$, which comprises the version-information $v_{info}$ on the started version $v_i$ of the first software, to the specific transmission device 14.1 since it identifies the started versions $V_{II}$, $v_i$ as compatible (see method step 54 in FIG. 2).

The specific transmission device 14.1 communicates its version-retain signal $S_{V\text{-}Erh}$ to the data memory 15.1 since it has identified the compatibility of the started one version $v_i$ of the first software and the started other version $V_{II}$ of the second software (see method step 55 in FIG. 2). In response to the version-retain signal $S_{V\text{-}Erh}$, the information on the other version $V_{II}$ of the second software—i.e. the major number "4"—remains stored or is stored anew in the data memory 15.1.

If the specific transmission device 14.1 were to possess a further version $V_{III}$ of the second software, which, for example, corresponds to "baseline 4", then information on this further version $V_{III}$ would be found in the third place in the list. Then, in the case of incompatibility of the started one version $v_i$ of the first software and the started other version $V_{II}$ of the second software, the specific transmission device would communicate the version-change signal to the data memory, wherein, in response to the version-change signal, instead of the information on the other version $V_{II}$ of the second software, information on the further version $V_{III}$ of the second software would be stored as version-information in the data memory.

Therefore, in the case of incompatibility of the started one version $v_i$ of the first software and the started other version $V_{II}$ of the second software, the specific transmission device 14.1 would automatically restart, and to be precise in response to the version-response signal, now with the further version $V_{III}$ of the second software.

And then, the started one version $v_i$ of the first software and the started further version $V_{III}$ of the second software would be checked for their compatibility.

In the case of compatibility of the started one version vi of the first software and the started further version VIII of the second software, the specific transmission device 14.1 would communicate the version-retain signal to the data memory 15.1, wherein, in response to the version-retain signal, the information on the further version $V_{III}$ of the second software would remain stored or be stored anew in the data memory 15.1.

In the exemplary embodiment shown, however, the started one version $v_i$ of the first software and the started other version $V_{II}$ of the second software are compatible. The onboard apparatus 7 on its part holds the interface 19 for further communication with the specific transmission device 14.1 since it identifies the started versions as compatible and the specific transmission device on its part also holds the interface 19 for further communication with the onboard apparatus 7 since it identifies the started versions as compatible.

In other words, with the described method, in the connection setup between the specific transmission device 14.1 and the onboard apparatus 7, it is possible to select the necessary version of the second software in connection with the non-volatile data memory 15.1. Or, expressed another way, the specific transmission device is able to select the baseline. Here, the specific transmission device 14.1 and the onboard apparatus 7 communicate with one other via the data bus 18 via which the connection is established. When starting (i.e. when running-up)—due to the major number "X" held resident in the data memory as version-information $V_{Info}$—it is first assumed in the specific transmission device 14.1 that the necessary version of the second software corresponds to one of the standard baselines. Therefore, it is first assumed that version of the second software required is that to which major number "X" stored in the data memory 15.1 is assigned according to UNISIG Specification SUBSET-035. The specific transmission device 14.1 starts with this version of the second software and attempts to use this to establish the connection to the STM control function unit 20 of the onboard apparatus 7 via the data bus 18.

This attempt can finish with one of the four following results:

a.) The connection is established successfully and the onboard apparatus 7 responds with its version-indication signal $S_{v_ang}$, which comprises the version-information $v_{info}$ on the started version of the first software—here by way of example also in the form of a major number "X" defined according to the UNISIG Specification SUBSET-035. The specific transmission device 14.1 identifies from the major numbers that the started version of the first software and the started version of the second software are compatible. In other words, the onboard apparatus responds to a baseline version format of the specific transmission device with a baseline version format and the specific transmission device identifies that the baseline version format of the onboard apparatus corresponds to its baseline version format—the started versions of the first software and the second software are compatible.

b.) The connection is established successfully and the onboard apparatus 7 responds with its version-indication signal $S_{v_ang}$, which comprises the version-information $v_{info}$ in the form of a major number "X". The specific transmission device identifies that the started version of the first software and the started version of the second software are incompatible. In other words, the onboard apparatus responds to the baseline version format of the specific transmission device with its baseline version format and the specific transmission device identifies that this baseline version format does not correspond to its baseline version format—the versions are incompatible.

c.) The connection is not established successfully, however, the onboard apparatus 7 still responds with its baseline version format before closing the connection. The specific transmission device 14.1 identifies that the started version of the first software and the started version of the second software are incompatible—i.e. it identifies that its baseline version format does not correspond to the baseline version format of the onboard apparatus 7.

d.) The connection is not established successfully, the onboard apparatus 7 closes the connection immediately without responding with its baseline version format. The specific transmission device 14.1 also identifies from the lack of response that the started version of the first software and the started version of the second software are incompatible.

Therefore, result a.) is obtained when the started version of the first software and the started version of the second software are compatible. If, however, these versions are incompatible, one of results b.), c.) or d.) is obtained.

In the case of compatibility (case A), the established connection is correct. I.e., the specific transmission device 14.1 has selected with its started version of the second software a software compatible with the started version of the first software of the onboard apparatus. In other words, the specific transmission device 14.1 has selected with its started baseline a baseline compatible with the baseline of the onboard apparatus. The specific transmission device ensures that this compatible baseline is stored in the data memory before it runs down and uses this baseline from the start in the event of the establishment of a subsequent connection. The entire data traffic, including with other functions of the onboard apparatus, for example the DMI or the BIU, is effected with a corresponding protocol format of this selected baseline. The onboard apparatus now has the condition of a configured baseline.

In the case of incompatibility (case B), the specific transmission device has not received confirmation of its baseline from the STM control function unit 20 of the onboard apparatus 7. The specific transmission device then assumes that the cause is incompatibility of the baseline. Therefore, the baseline of the specific transmission device 14.1 is changed. The information on the newly selected baseline is stored in the data memory 15.1 as version-information.

This case B prevails first with the exemplary embodiment shown in FIG. 2 with which the specific transmission terminal first starts with baseline 2 and then changes to baseline 3.

A new connection is established with the two devices 7 and 14.1. This takes place by restarting the two devices. The specific transmission device 14.1 again attempts to connect the onboard apparatus 7, but now with the new baseline. Once again, the above-described case differentiation takes place. If the new baseline of the specific transmission device 14.1 is now compatible with the baseline of the onboard apparatus 7, case A takes effect. If not, case B prevails again. With the exemplary embodiment shown in FIG. 2, case A now prevails and so the specific transmission device retains baseline 3.

Therefore, the train safety assembly 34 according to the invention enables the specific transmission device to be connected with both currently usual embodiments of the onboard apparatus—i.e. with a version of the first software according to baseline 2 or with a version of the first software according to baseline 3; hitherto this could only be achieved by a complete replacement of devices.

A completely refreshed selection of the baseline of the specific transmission device 14.1 is effected by deleting the stored version-information $V_{Info}$.

The preselection of the desired baseline can be effected by the selective targeted storage of information on one of the available versions of the second software—in other words by the selective storage of a baseline. If the information on this preselected version of the second software is not in first place in the list, the selection is continued with the information in first place if both the first preselected version and all versions with information that comes after the information for the preselected version in the list have been found to be incompatible.

However, here, the specific transmission device is embodied such that it does not start any of the available versions of the second software automatically twice. Therefore, if all available versions of the second software are found to be incompatible with the version of the first software, no automatic restart of the specific transmission device takes place or any such restart would be aborted.

The invention claimed is:

1. A method for operating a train safety assembly (34) having an onboard apparatus of a first train safety system with a specific transmission device connected to the onboard apparatus via an interface, and configured for communication with a trackside part of a second train safety system, the method comprising:

starting the onboard apparatus using a given version of a first software;

starting the specific transmission device using a given version of a second software;

checking the given version of the first software and the given version of the second software for compatibility;

in the case of incompatibility of the given version of the first software and the given version of the second software, automatically restarting the specific transmission device with another version of the second software; and checking the given version of the first software and the other version of the second software for compatibility.

2. The method according to claim 1, wherein, in the case of incompatibility of the given version of the first software and the started other version of the second software, automatically restarting the specific transmission device with a further version of the second software and checking the given version of the first software and the started further version of the second software for compatibility.

3. The method according to claim 1, which comprises, on each restart of the specific transmission device, automatically restarting the onboard apparatus with the given version of the first software.

4. The method according to claim 1, wherein a data memory with stored version-information on the version of the second software to be started is assigned to the specific transmission device, and the method further comprises:

on each start and on each restart, determining the version of the second software to be started by transmitting from the specific transmission device a version-request signal to the data memory via a data-transmission connection;

in response to the version-request signal, communicating with the data memory a version-response signal comprising the stored version-information on the version of the second software to be started to the specific transmission device via the data-transmission connection; and in response to the version-response signal, starting the version of the second software to be started with the specific transmission device.

5. The method according to claim 4, wherein the data memory is a non-volatile data memory.

6. The method according to claim 4, which comprises, before the specific transmission device starts, storing information on the given version of the second software as version-information in the data memory so that, in response to the version-response signal, the specific transmission device starts with the one version of the second software.

7. The method according to claim 5, which comprises:

in the case of compatibility of the given version of the first software with the given version of the second software, the specific transmission device communicates a version-retain signal to the data memory; and in response to the version-retain signal, retaining the information on the given version of the second software or storing the information anew in the data memory.

8. The method according to claim 5, which comprises:

in the case of incompatibility of the given version of the first software and the given version of the second software, communicating with the specific transmission device a version-change signal to the data memory; and in response to the version-change signal, instead of the information on the given version of the second software, storing information on the other version of the second software as version-information in the data memory so that, in response to the version-response-signal, the specific transmission device restarts with the other version of the second software.

9. The method according to claim 8, wherein, in the case of compatibility of the given version of the first software and the started other version of the second software, communicating with the specific transmission device a version-retain signal to the data memory, and in consequence of the version-retain signal, retaining the information on the other version of the second software stored in the data memory or storing the information anew in the data memory.

10. The method according to claim 8, wherein, in the case of incompatibility of the given version of the first software and the started other version of the second software, communicating with the specific transmission device a version-change signal to the data memory; and in response to the version-change signal, instead of the information on the other version of the second software, storing information on the further version of the second software as version-information in the data memory so that, in response to the version-response signal, the specific transmission device restarts with the further version of the second software.

11. The method according to claim 6, wherein the specific transmission device communicates a version-indication signal comprising the version-information on the started version of the second software to the onboard apparatus via the interface, that the onboard apparatus uses the communicated version-information on the started version of the second software and version-information on the started version of the first software to check whether the started versions are compatible or incompatible; and the onboard apparatus blocks the interface for further communication with the specific transmission device if it identifies the started versions as incompatible;

the onboard apparatus communicates a version-indication signal comprising the version-information on the started version of the first software to the specific transmission device via the interface if it identifies the started versions as compatible;

the specific transmission device uses the communicated version-information on the started version of the first software and the version-information on the started version of the second software to check whether the started versions are compatible or incompatible;

the specific transmission device blocks the interface for further communication with the onboard apparatus if it identifies the started versions as incompatible;

the specific transmission device communicates the version-change signal to the data memory if it identifies the started versions as incompatible; and the specific transmission device communicates the version-retain signal to the data memory if it identifies the started versions as compatible.

12. The method according to claim 11, wherein the onboard apparatus keeps the interface free for further communication with the specific transmission device if the started versions are identified as compatible and the specific transmission device keeps the interface free for further communication with the onboard apparatus if the started versions are identified as compatible.

13. The method according to claim 7, wherein the specific transmission device communicates a version-indication signal comprising the version-information on the started version of the second software to the onboard apparatus via the interface, that the onboard apparatus uses the communicated version-information on the started version of the second software and version-information on the started version of the first software to check whether the started versions are compatible or incompatible; and the onboard apparatus blocks the interface for further communication with the specific transmission device if it identifies the started versions as incompatible;

the onboard apparatus communicates a version-indication signal comprising the version-information on the started version of the first software to the specific transmission device via the interface if it identifies the started versions as compatible;

the specific transmission device uses the communicated version-information on the started version of the first software and the version-information on the started version of the second software to check whether the started versions are compatible or incompatible;

the specific transmission device blocks the interface for further communication with the onboard apparatus if it identifies the started versions as incompatible;

the specific transmission device communicates the version-change signal to the data memory if it identifies the started versions as incompatible; and the specific transmission device communicates the version-retain signal to the data memory if it identifies the started versions as compatible.

14. The method according to claim 13, wherein the onboard apparatus keeps the interface free for further communication with the specific transmission device if the started versions are identified as compatible and the specific transmission device keeps the interface free for further communication with the onboard apparatus if the started versions are identified as compatible.

15. The method according to claim 1, which comprises:

providing the given version of the first software of the onboard apparatus and the versions of the software of the specific transmission device in accordance with a System Requirements Specification Version of a European Train Safety System, wherein the System Requirements Specification versions of the European Train Safety System are different from those corresponding to different versions of the second software of the specific transmission device.

16. The method according to claim 4, wherein the version-information on the respective version of the software is provided in form of a number.

17. A train safety assembly for a rail vehicle, comprising an onboard apparatus of a first train safety system and a specific transmission device, which is connected via an interface to said onboard apparatus and which is adapted to a trackside part of a second train safety system, and wherein the train safety assembly is configured to carry out the method according to claim 1.

18. A rail vehicle, comprising a train safety assembly according to claim 17.

* * * * *